US007204816B2

(12) United States Patent
Yano et al.

(10) Patent No.: US 7,204,816 B2
(45) Date of Patent: Apr. 17, 2007

(54) MASSAGING APPARATUS

(75) Inventors: Takeshi Yano, Kyoto (JP); Yuichi Nishibori, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 118 days.

(21) Appl. No.: 11/009,022

(22) Filed: Dec. 13, 2004

(65) Prior Publication Data

US 2005/0137504 A1 Jun. 23, 2005

(30) Foreign Application Priority Data

Dec. 22, 2003 (JP) ..... 2003-425855

(51) Int. Cl.
*A61H 19/00* (2006.01)

(52) U.S. Cl. ..... 601/93; 601/95

(58) Field of Classification Search ..... 601/83–95
See application file for complete search history.

(56) References Cited

FOREIGN PATENT DOCUMENTS

| | | |
|---|---|---|
| JP | 07-227413 | 8/1995 |
| JP | 2000-350765 | 12/2000 |

OTHER PUBLICATIONS

English language Abstract of JP 2000-350765.
English language Abstract of JP 07-227413.

*Primary Examiner*—Michael A. Brown
(74) *Attorney, Agent, or Firm*—Greenblum & Berstein, P.L.C.

(57) ABSTRACT

A massaging apparatus is provided with a treating section having a length longer than a width for massaging a body of the user in a tapping movement. The treating section includes a first treating part and a second treating part which are arranged in the longitudinal direction of the treating section. The apparatus is further provided with a switcher which switches over the position of the second treating part relative to the first treating part in a tapping direction to selectively change from a first state where the first treating part and the second treating part are flush with each other to a second state where the second treating part protrudes relative to the first treating part, and vice versa.

3 Claims, 7 Drawing Sheets

MASSAGING APPARATUS

BACKGROUND OF THE INVENTION

1. Field of the Invention

The present invention relates to a hand-held massaging apparatus, and more particularly to a massaging apparatus that enables to cause chopped-like sensation by solenoid control as well as local massaging.

2. Description of the Related Art

Heretofore, there has been known a massaging apparatus, as disclosed in Japanese Unexamined Patent Publication No. 2000-350765, wherein chopped-like sensation is caused by driving a treating section having a relatively long length and a relatively narrow width by a solenoid. This apparatus, however, fails to satisfy a user's wish to massage a specific site of the body locally because of its long treating section.

There is proposed a massaging apparatus equipped with a treating section having a pointed round tip (see Japanese Unexamined Patent Publication No. 7-227413) in an attempt to pursue a local massaging. Such an apparatus, however, fails to provide the massaging of giving chopped-like sensation to the user.

SUMMARY OF THE INVENTION

It is an object of the present invention to provide a massaging apparatus that is free from the problems residing in the prior art.

It is another object of the present invention to provide a massaging apparatus that enables to selectively switch over an extensive massaging of causing chopped-like sensation and a local massaging of causing finger-pressed-like sensation.

According to an aspect of the present invention, a massaging apparatus is provided with a treating section for massaging a desired body portion of the user. The treating section has a length longer than a width. The treating section includes a first treating part and a second treating part. The massaging apparatus is provided with a switcher for switching over the position of the second treating part relative to the first treating part in a tapping direction to selectively change from a first state where the first treating part and the second treating part are flush with each other to a second state where the second treating part protrudes relative to the first treating part, and vice versa.

In this construction, the extensive massaging is performed by making the first treating part and the second treating part flush with each other, and the local massaging is performed by making the second treating part protrude relative to the first treating part.

These and other objects, features and advantages of the present invention will become more apparent upon reading of the following detailed description along with the accompanying drawings.

DETAILED DESCRIPTION OF THE PREFERRED EMBODIMENTS OF THE PRESENT INVENTION

Figure 1:
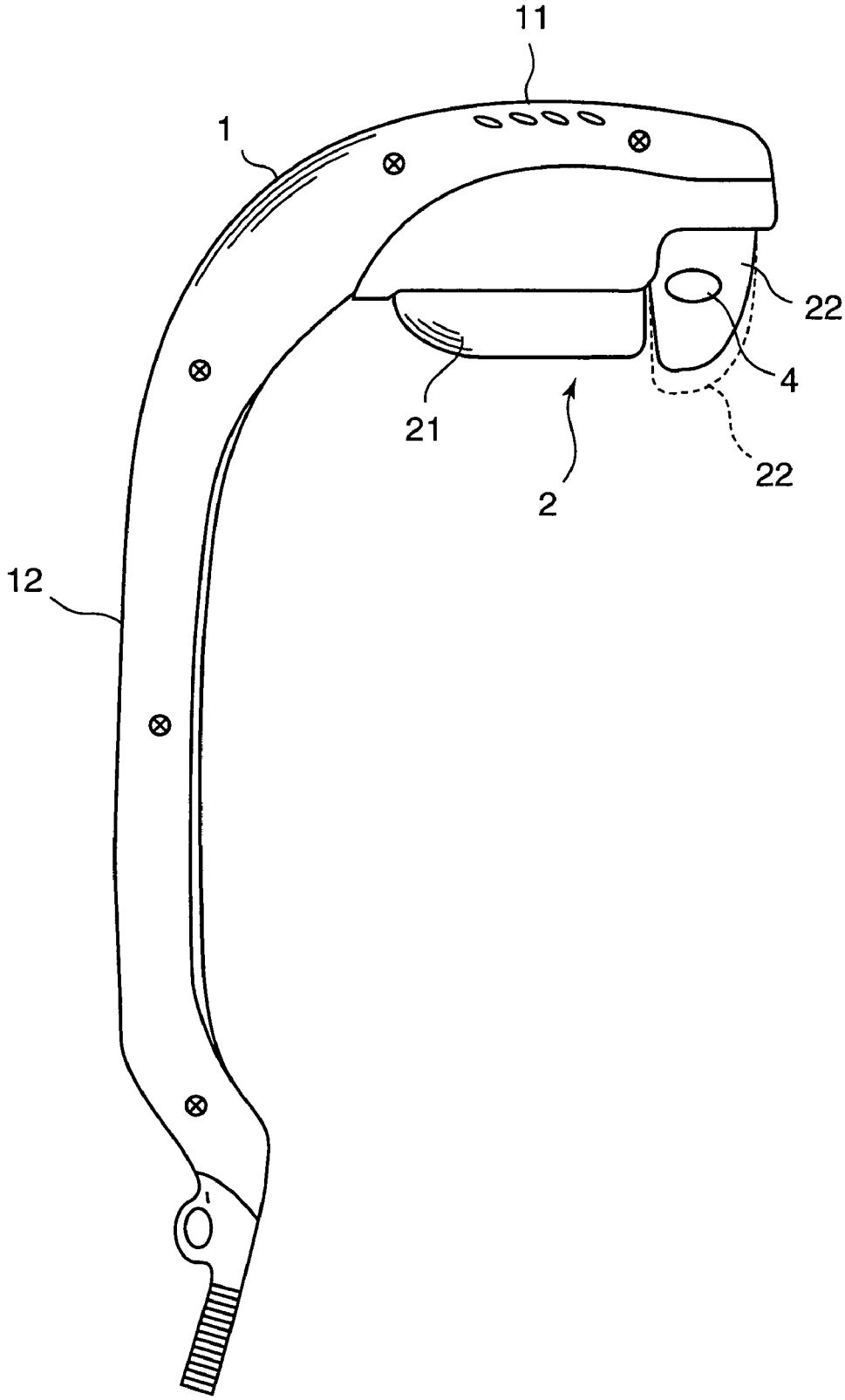
FIG. 1 is a side view of a massaging apparatus according to an embodiment of the present invention.

A preferred embodiment of the present invention will be described referring to the accompanying drawings. It should be appreciated that like elements throughout the specification are denoted at the same reference numerals.

Figure 2:
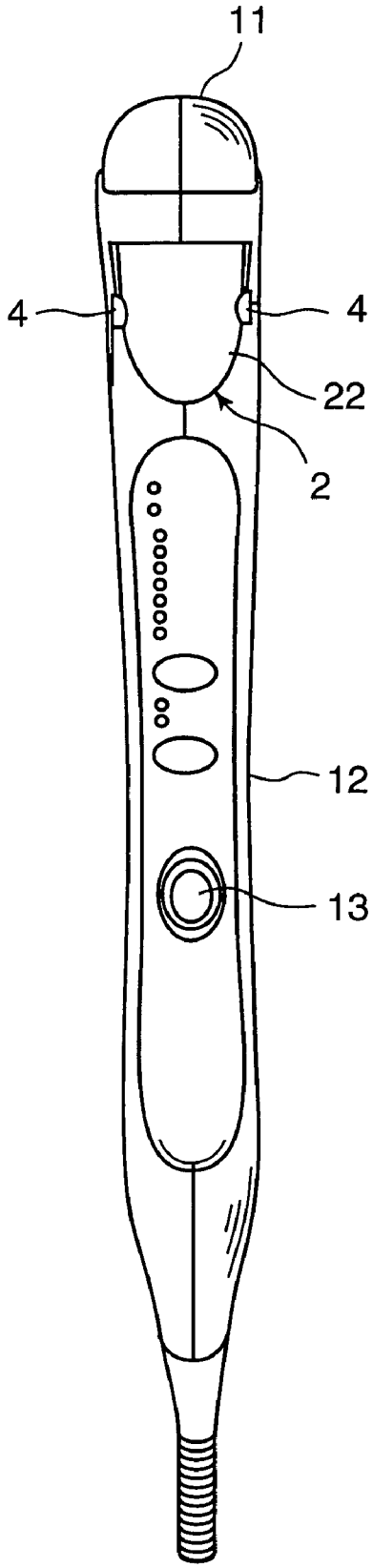
FIG. 2 is a front view of the massaging apparatus.

Referring to FIGS. 1 and 2, a main body 1 of a massaging apparatus embodying the present invention has a generally L-shape including a grip section 12 to be gripped by a hand of a user, and a head section 11 extending from an upper end of the grip section 12 at a certain angle. The main body 1 has a treating section 2 on a lower part of the head section 11. The treating section 2 has a length longer than a width thereof.

Figure 3:
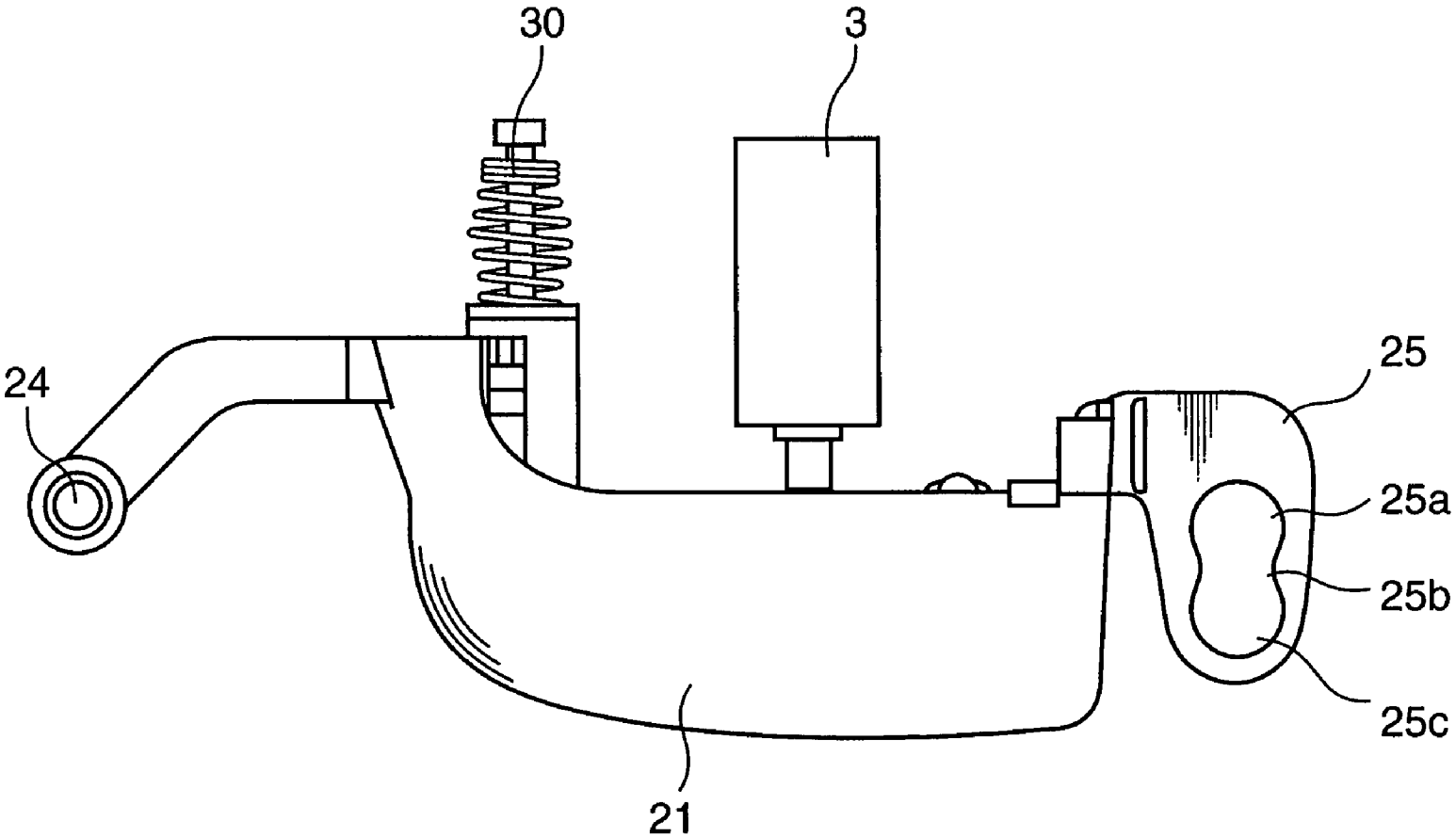
FIG. 3 is a side view of a treating section of the massaging apparatus.

The treating section 2 has a first treating part 21 and a second treating part 22 arranged along the longitudinal direction thereof. As shown in FIGS. 1, 2, and 3, the first treating part 21 has a sufficiently long length, and is interconnected with the head section 11 by a plunger of a solenoid device 3 (see FIG. 3) fixedly provided in the head section 11 of the main body 1 by way of a coil spring (not shown).

As shown in FIG. 3, the first treating part 21 is formed with a hole 24 at one longitudinal end thereof, and an interlocking part 25 at the other longitudinal end thereof. The first treating part 21 is pivotally supported on the head section 11 about a connecting shaft placed through the hole 24. The second treating part 22 is interlocked with the first treating part 21 at the interlocking part 25 of the first treating part 21. The first treating part 21 is pivoted about the shaft through the hole 24. Referring to FIG. 3, an interlock spring 30 is connected with the head section 11 at an upper end thereof, and is adapted to control the movement of the first treating part 21 and the second treating part 22 interlocked with the first treating part 21, while the first treating part 21 is driven by the solenoid device 3.

The second treating part 22 having a length shorter than that of the first treating part 21 is interlocked with the first treating part 21 at the interlocking part 25 of the first treating part 21. The second treating part 22 has a pointed round tip effective to cause a finger-press-like sensation. When the solenoid device 3 is activated, the second treating part 22 is driven in cooperation with the first treating part 21 in such a manner that the second treating part 22 is slidably movable up and down relative to the first treating part 21, and that the second treating part 22 is fixedly positioned at one of two vertically different positions relative to the first treating part 21.

Figure 4A:
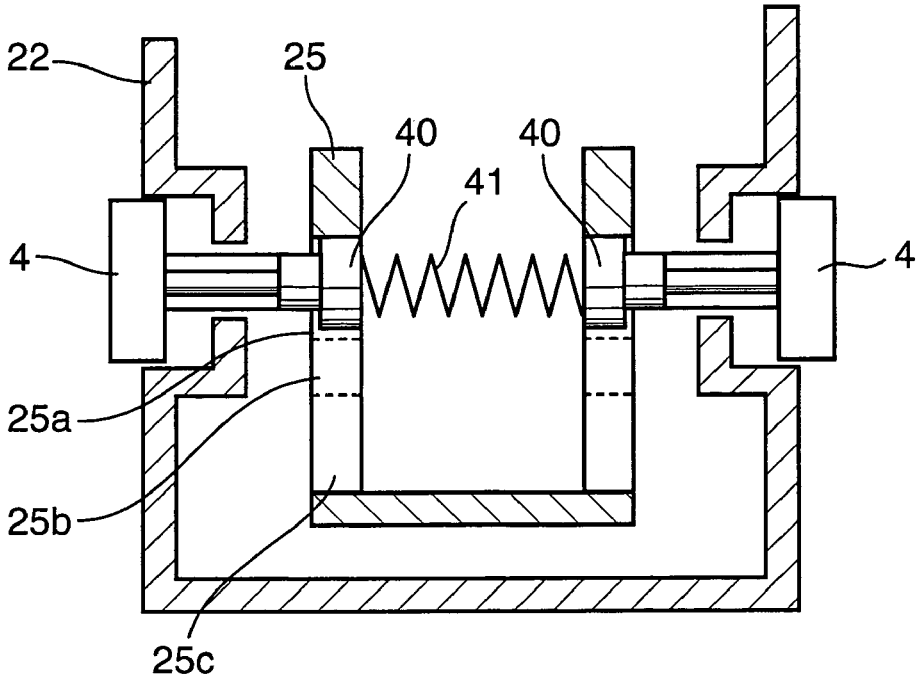
FIGS. 4A and 4B are cross-sectional views each showing a locking mechanism of the massaging apparatus.
Figure 4B:
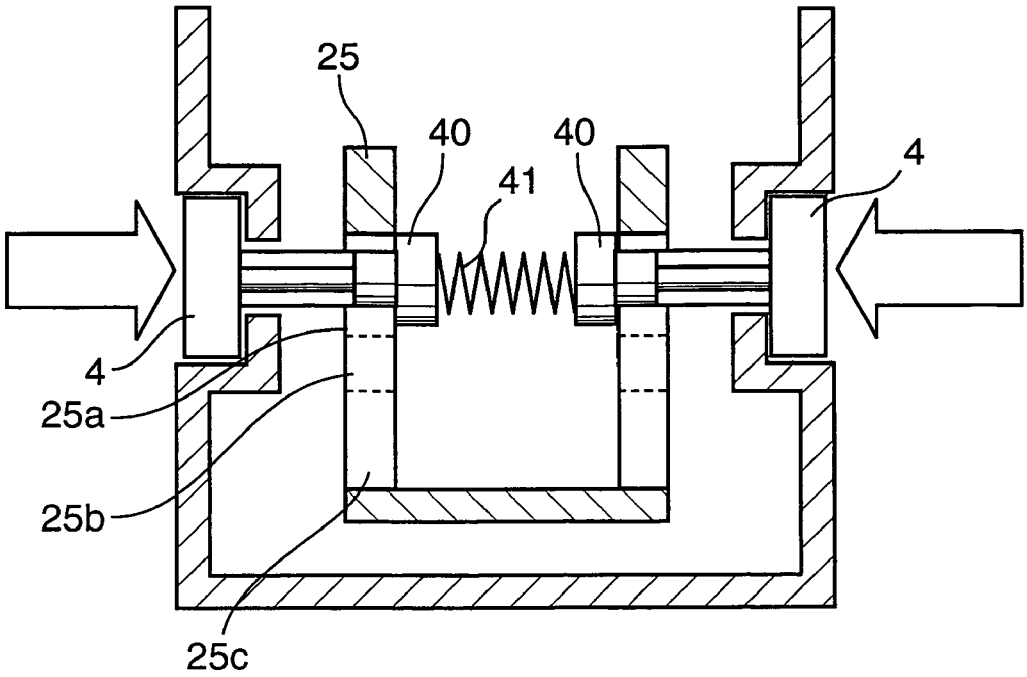

Specifically, a pair of two large-diametrical holes 25*a*, 25*c* vertically aligned away from each other is formed in each of side walls of the interlocking part 25 in such a manner that the holes 25*a*, 25*c* are communicated with each other by a bridging groove 25*b* having a width smaller than the diameter of the hole 25*a* (25*c*). As shown in FIGS. 4A and 4B, a switching button 4 is arranged at each of side walls of the second treating part 22, and a locking member 40 having such a size as to fit in the large-diametrical hole 25*a* or 25*c* is arranged at a certain position corresponding to each of the switching buttons 4. As shown in FIG. 4A, the locking member 40 (40) is normally locked in the large-diametrical hole 25*a* or 25*c* by urging force of a resilient spring 41 provided between the locking members 40 and 40 to thereby restrain the second treating part 22 from vertically sliding relative to the first treating part 21. On the other hand, as shown in FIG. 4B, pushing the switching buttons 4 inwardly as shown by the arrows unlock the locking members 40, 40 from the large-diametrical holes 25*a* or 25*c*, with the result that the first treating part 21 is slidably movable downward or upward. Thereafter, locking the locking members 40, 40 in the large-diametrical holes 25*c* or 25*a*, which are different from the previously locked holes enables to fixedly position the second treating part 22 relative to the first treating part 21 at the vertically different position from the previously locked position.

When the second treating part 22 is fixedly positioned at the upper position, namely, at a position corresponding to the holes 25*a* relative to the first treating part 21, as shown by the solid line in FIG. 1, the bottom surface of the first treating part 21 and the bottom surface of the second treating part 22 are substantially made flush with each other. Thereby, massaging effect by chopped-like sensation can be obtainable by actuating the first treating part 21 and the second treating part 22 integrally as a single massaging member.

On the other hand, when the second treating part 22 is fixedly positioned at the lower position, namely, at a position corresponding to the holes 25*c* relative to the first treating part 21, as shown by the broken line in FIG. 1, the second treating part 22 protrudes downward relative to the first treating part 21. Thereby, locally effective massaging is effectuated by the second treating part 22 which is shorter in length and narrower in width than the first treating part 21.

Figure 5A:
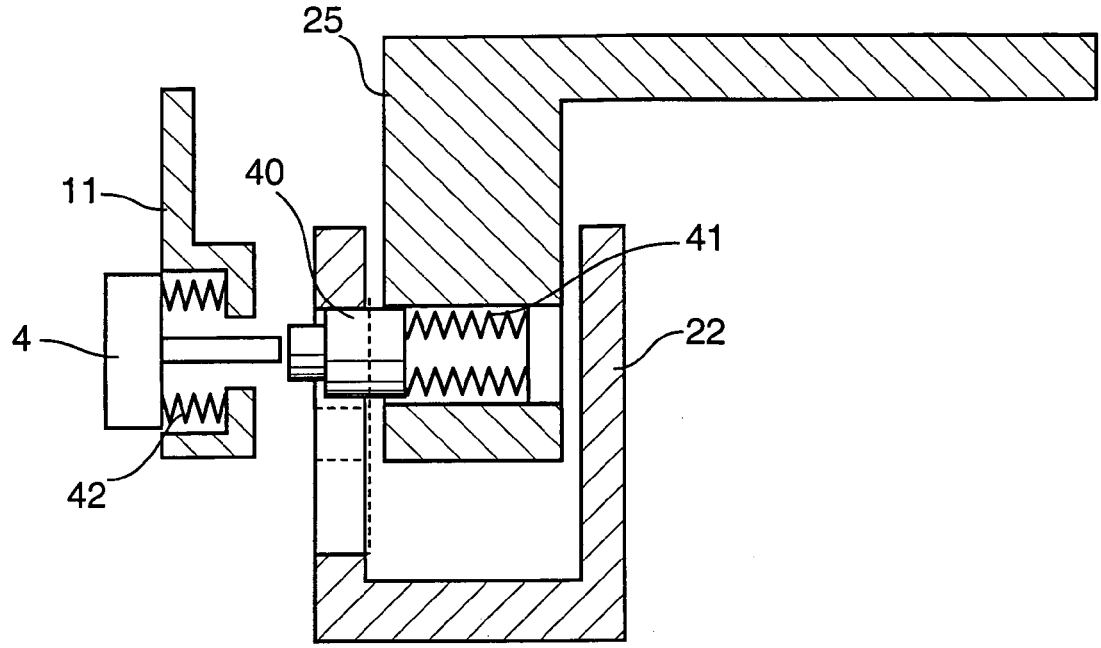
FIGS. 5A and 5B are cross-sectional views each showing a modified locking mechanism of the embodiment of the present invention.
Figure 5B:
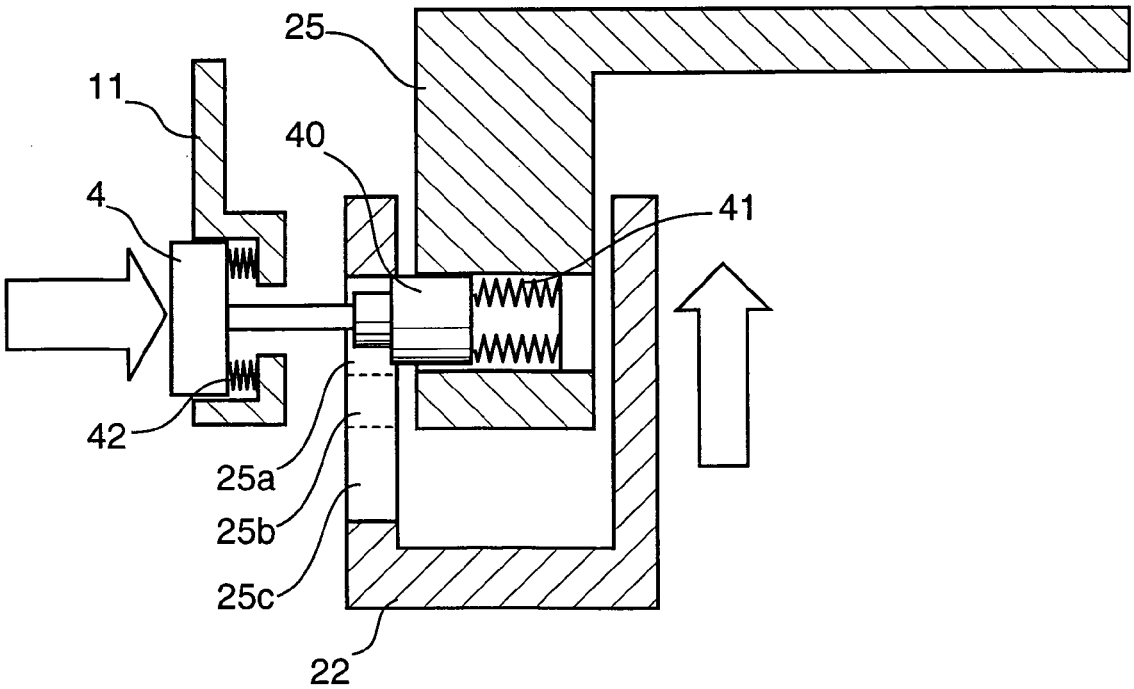

FIGS. 5A and 5B show a modified locking mechanism of the embodiment. As shown in FIGS. 5A and 5B, the modified massaging apparatus is constructed such that a switching button 4 and a locking member 40 are individually provided. Specifically, the switching button 4 is arranged on an outer wall of a main body 1, the locking member 40 is arranged at an appropriate position of an interlocking part 25 of a first treating part 21, and large-diametrical holes 25*a*, 25*c* with a bridging groove 25*b* are formed in a second treating part 22. In the massaging apparatus, normally, the locking member 40 is locked in the large-diametrical hole 25*a* or 25*c* by urging force of a resilient spring 41 to thereby restrain the second treating part 22 from vertically sliding relative to the first treating part 21. Then, pushing the switching button 4 inwardly as shown by the horizontal arrow in FIG. 5B against the resilient force of the resilient spring 41 enables to unlock the locking member 40 from the large-diametrical hole 25*a* or 25*c*, with the result that the first treating part 21 is slidably movable downward or upward relative to the second treating part 22. Thereafter, locking the locking member 40 in the large diametrical hole 25*c* or 25*a*, which is different from the formally locked hole enables to fixedly position the second treating part 22 relative to the first treating part 21 at the vertically different position from the previously locked position.

Figure 6A:
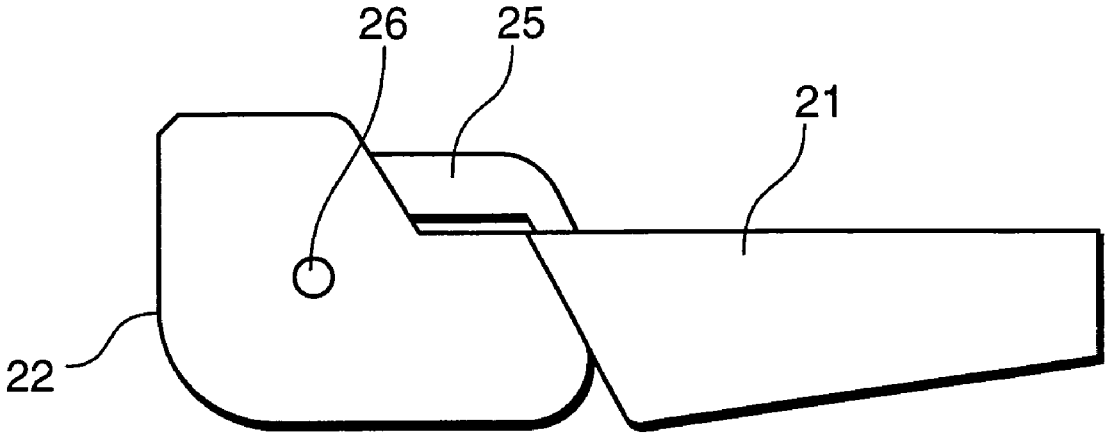
FIGS. 6A and 6B are side views each showing a modified treating section of the embodiment of the present invention.
Figure 6B:
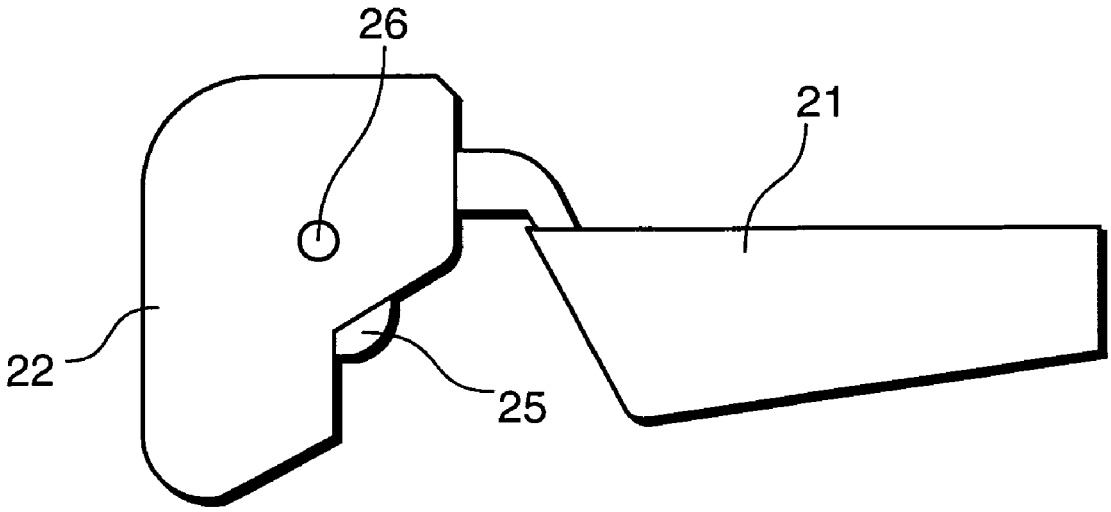
Figure 7A:
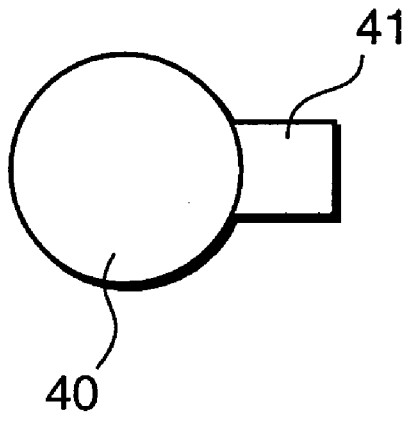
FIG. 7A is an illustration showing a locking member of the modified treating section.
Figure 7B:
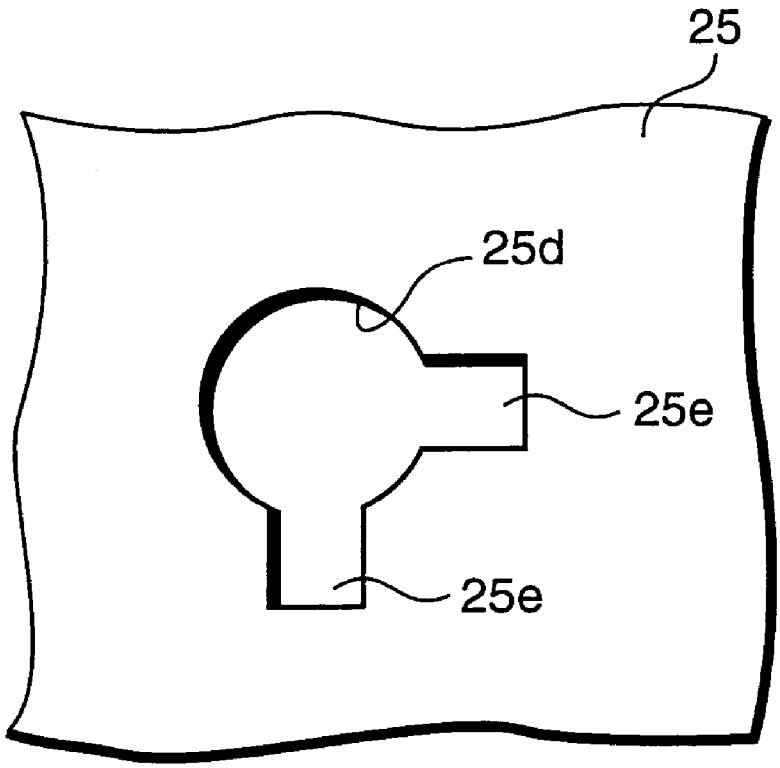
FIG. 7B is an illustration showing an engaging hole in which the locking member is to be engaged.

FIGS. 6A through 7B show a modified treating section of the embodiment. As shown in FIGS. 6A and 6B, the modified treating section 2 is constructed such that a second treating part 22 is interlocked with a first treating part 21 by an interlocking part 25 in such a manner that the second treating part 22 is pivotally rotatable about an axis of a shaft 26. By pivotally rotating the second treating part 22 by 90°, the massaging apparatus is switched over between a state that the second treating part 22 and the first treating part 21 are made flush with each other, and a state that the second treating part 22 protrudes downward relative to the first treating part 21. The second treating part 22 is selectively fixed to one of the two states by forming grooves 25*e*, 25*e* that are continuous from an engaging hole 25*d* formed in the interlocking part 25 and extend in two different directions, as shown in FIG. 7B, and by forming a protrusion 41 on an outer wall of a locking member 40, as shown in FIG. 7A in place of the locking mechanism as shown in FIGS. 4A and 4B. With this arrangement, while the locking member 40 is locked in the engaging hole 25*d*, the second treating part 22 is selectively positioned relative to the first treating part 21 at one of two different positions by engagement of the protrusion 41 in one of the two grooves 25*e*, 25*e*.

As described above, an inventive massaging apparatus comprises: a treating section having a length longer than a width for massaging a body of the user in a tapping movement, the treating section including a first treating part and a second treating part which are arranged in the longitudinal direction of the treating section; and a switcher which switches over the position of the second treating part relative to the first treating part in a tapping direction to selectively change from a first state where the first treating part and the second treating part are flush with each other to a second state where the second treating part protrudes relative to the first treating part, and vice versa.

It may be preferable that one of the first treating part and the second treating part is slidably movable relative to the other.

Also, it may be preferable that one of the first treating part and the second treating part is rotatably movable relative to the other.

The massaging apparatus not only provides massaging effect by chopped-like sensation when the first treating part and the second treating part are made flush with each other, but also provides massaging effect of locally and intensively massaging a desired site of the user's body where the user feels severe stiffness or tension by changing the position of second treating part and the first treating part relative to the other, whereby more effective massaging is provided with a simplified construction.

Furthermore, the treating section is divided into the first treating part and the second treating part in the longitudinal direction thereof in such a manner that the massaging effect by chopped-like sensation is provided when the first treating part and the second treating part are made flush with each other. This arrangement ensures a sufficiently long treating area, thereby providing massaging effect by chopped-like sensation easily and securely.

This application is based on Japanese Patent Application No. 2003-425855 filed on Dec. 22, 2003, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A massaging apparatus comprising:

a grip section to be gripped by a hand of a user;

a head section extending from the grip section at an angle, the head section having a free end;

a treating section supported on the head section and having a length longer than a width for massaging a body of a user in a tapping movement, the treating section including a first treating part and a second treating part which are arranged in the longitudinal direction of the treating section, the second treating part having a pointed tip effective to cause a finger-press-like sensation, and being operable to project from the first treating part, and being spaced in the longitudinal direction of the treating section from the first treating part so as to be positioned nearer to the free end of the head section than the first treating part; and a switcher which switches over the position of the second treating part relative to the first treating part in a tapping direction to selectively change between a first condition where the first treating part and the second treating part are flush with each other and a second condition where the second treating part projects from the first treating part.

2. The massaging apparatus according to claim 1, wherein one of the first treating part and the second treating part is slidably movable relative to the other.

3. The massaging apparatus according to claim 1, wherein one of the first treating part and the second treating part is rotatably movable relative to the other.

* * * * *